US007699068B2

(12) United States Patent
Helsdon

(10) Patent No.: US 7,699,068 B2
(45) Date of Patent: Apr. 20, 2010

(54) HAMMOCK TENT

(76) Inventor: David Helsdon, RR #1, Straffordville, ON (CA) N0J 1Y0

( * ) Notice: Subject to any disclaimer, the term of this patent is extended or adjusted under 35 U.S.C. 154(b) by 0 days.

(21) Appl. No.: 12/056,678

(22) Filed: Mar. 27, 2008

(65) Prior Publication Data

US 2008/0236642 A1 Oct. 2, 2008

Related U.S. Application Data

(60) Provisional application No. 60/908,475, filed on Mar. 28, 2007.

(51) Int. Cl.
*E04H 15/04* (2006.01)
*E04H 15/02* (2006.01)
*A45F 3/22* (2006.01)

(52) U.S. Cl. ..... 135/90; 135/96; 5/121

(58) Field of Classification Search ..... 135/90, 135/96, 95, 117; 5/120–123, 127, 128
See application file for complete search history.

(56) References Cited

U.S. PATENT DOCUMENTS 348,685 A * 9/1886 Nelmes ..... 5/121
482,275 A * 9/1892 Roach ..... 5/98.1
1,156,200 A * 10/1915 Ashworth ..... 5/121
1,260,845 A * 3/1918 Winder ..... 5/113
2,375,792 A * 5/1945 Kearny ..... 5/121
2,569,596 A * 10/1951 Anderegg ..... 5/127
4,001,902 A * 1/1977 Hall et al. ..... 5/121
4,071,917 A * 2/1978 Mojica ..... 5/121
4,308,883 A * 1/1982 Malone ..... 135/90
4,320,542 A * 3/1982 Cohen ..... 5/121
4,975,994 A * 12/1990 Barmettler ..... 5/120
5,035,012 A * 7/1991 Westrich ..... 5/139
5,113,537 A * 5/1992 Turk ..... 5/121
5,579,548 A * 12/1996 Death ..... 5/127
5,913,772 A * 6/1999 Clark ..... 5/121
6,851,137 B2 * 2/2005 Hennessy ..... 5/120
7,020,915 B1 4/2006 Helsdon

FOREIGN PATENT DOCUMENTS

CN 2935946 Y * 8/2007

* cited by examiner

*Primary Examiner*—David Dunn
*Assistant Examiner*—Tania Abraham

(57) ABSTRACT

An improved tent covers a hammock suspended from a pair of upright members by suspending means at each end of the hammock. The tent is formed from top and bottom portions that interact to provide a tent opening that prevents the entry of atmospheric precipitation when the tent opening is open. The tent also provides improved visibility from inside the tent, by enabling a horizontal field of view.

7 Claims, 11 Drawing Sheets

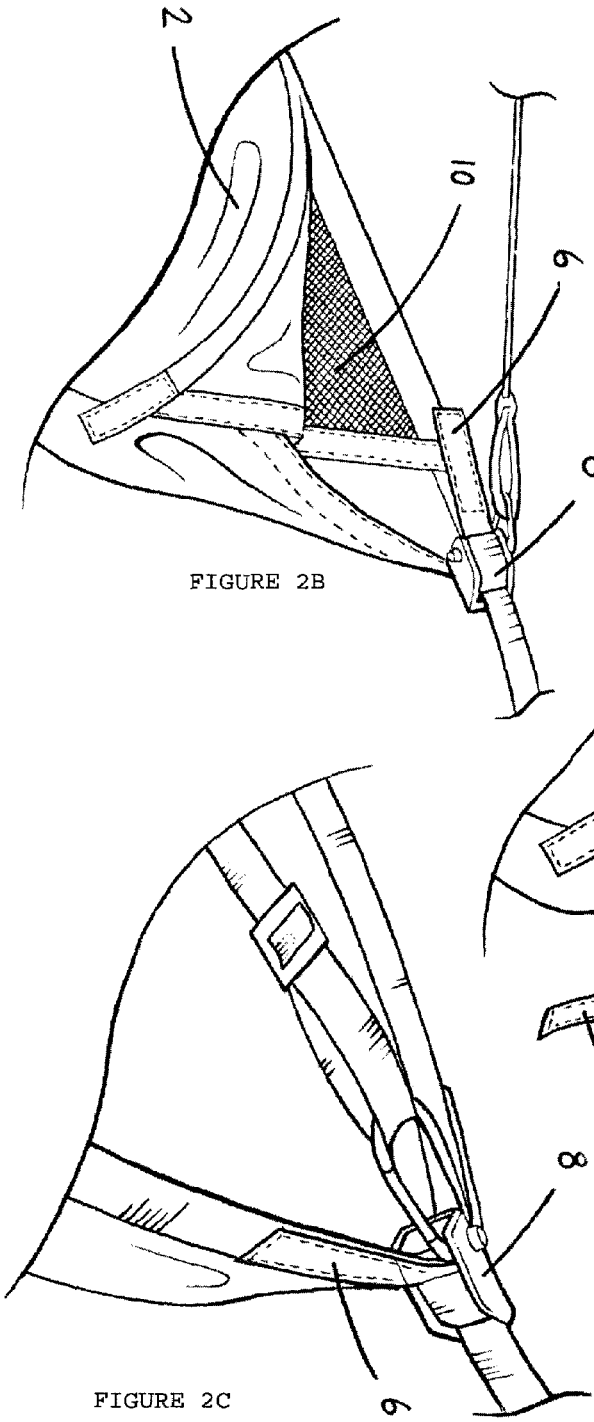
FIGURE 2C
FIGURE 2B
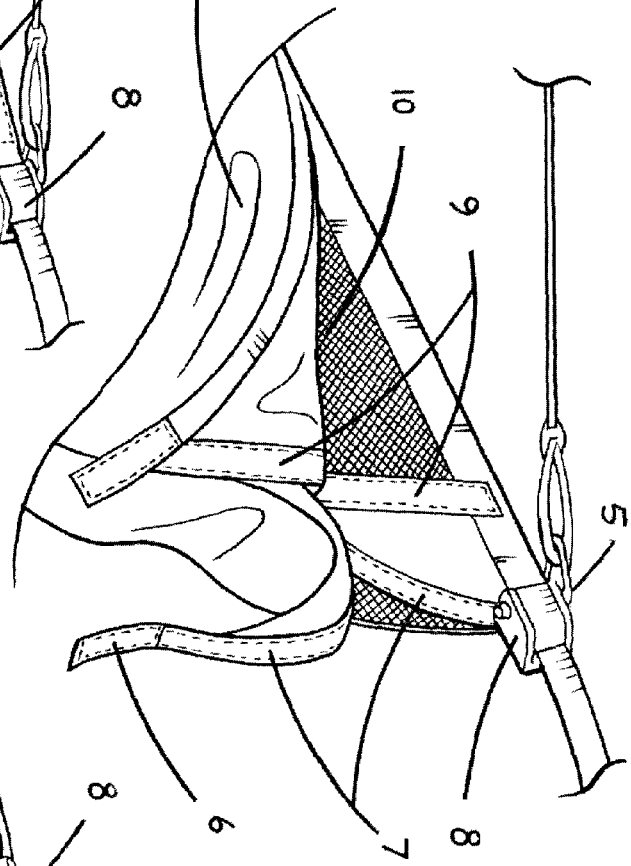
FIGURE 2A

HAMMOCK TENT

CROSS-REFERENCE TO RELATED APPLICATIONS

This application is a nonprovisional of, and claims benefit of priority under 35 USC 119 from, U.S. Ser. No. 60/908,475, filed 28 Mar. 2007, which is incorporated by reference as if fully recited herein.

TECHNICAL FIELD

The present invention relates to an improved hammock tent having an improved means of suspending a hammock.

BACKGROUND OF THE ART

The inventor herein is the inventor and owner of U.S. Pat. No. 7,020,915 ("the '915 patent"), issued 4 Apr. 2005, which is incorporated by reference as if fully recited herein. As shown in FIGS. 5 and 6 of the '915 patent, the hammock tent 60 comprises overlapping sections that completely surround the hammock 1. FIGS. 5 and 6 also show flap 69 that serves as a door. The tent 60 is supported by a supporting system having a ridge support, side supports and suspension supports.

Referring to FIG. 6 of the '915 patent, the door 69 of the tent 60 is located in the inclined upper portion of the tent 1. As a result, the occupier of the hammock cannot enter or exit the hammock, or leave the door open, without potential atmospheric precipitation entering the tent. Also, when the door is open, the field of view of the occupant is limited to an upward direction.

As shown in FIGS. 10A and 10B of the '915 patent, the hammock 1 is connected to suspending means by way of cargo hook 90. The cargo hook 90 is also connected to suspending strap 99 as described in FIGS. 9A and 9B. The suspending strap 99 is secured to an upright structure by means of cam buckle 200, as depicted in FIGS. 11 and 12.

In order to suspend the hammock, first the hammock and the suspending strap must be attached to the cargo hook. Second, the suspending strap must be wrapped around the structure and then fitted into the slot of the cam buckle. Accordingly, a simpler method of suspending the hammock is preferable.

SUMMARY OF THE INVENTION

The present invention provides an improved tent constructed such that no atmospheric precipitation can enter the tent when the tent door is open. This allows the hammock occupier to keep the door open, as well as enter and exit the tent without exposing the hammock to atmospheric precipitation. In addition the present invention provides improved visibility from inside the tent, by enabling a horizontal field of view.

The tent of the present invention consists of two portions, a top portion and a bottom portion. The bottom portion fits around the bottom of the hammock. The bottom portion is secured to the hammock by means such as ties, snaps or hook and loop fastener, such as that available commercially under the brand name VELCRO®. The bottom portion preferably contains vents at both ends.

The top portion fits overtop the tent support structure taught in the '915 patent and is equipped with means such as ties, snaps or hook and loop fastener, such as that available commercially under the brand VELCRO® to secure it to both the bottom portion as well as the side supports of the supporting system. When both the top and bottom portions are secured in place, a tent structure is constructed with an opening on each side of the hammock.

The opening in the tent is located under the inclined top portion of the tent, such that the top portion overhangs the opening. Therefore, potential atmospheric precipitation falling on the tent rolls down and off the sides of the top portion, without entering the tent through the opening.

The opening is provided with a door to permit an occupant of the hammock to close the tent. The door consists of two parts: a bug screen and a curtain that can be operated independent of one another. The bug screen and curtain can also be attached to one another by means such as ties, snaps or hook and loop fastener, such as that available commercially under the brand VELCRO®, and be operated as one unit.

Both the bug screen and curtain consist of a single piece of material extending from one side of the hammock to the other, covering both lateral openings of the tent. The bug screen and curtain are fitted through the space between the hammock and the bottom portion of the tent. Accordingly, when the hammock occupier opens the door, the bug screen and curtain can simply be dropped and stored therein.

In order to close the door, the hammock occupier can attach the bug screen and curtain to the inside of the two side-supports by means of ties, snaps or hook and loop fastener.

The present invention also provides an improved means of suspending the hammock to an upright structure. The improved means of suspending the hammock comprises a cam buckle that is permanently attached to each end of the hammock and which replaces the cargo hook of the '915 patent.

Also attached to the cam buckle is one end of the suspending strap. The other end of the suspending strap is attached to a cargo hook. In order to secure the hammock to an upright structure the suspending strap is wrapped around the structure and the cargo hook is secured to a D-ring through which the suspending strap is fitted. Alternatively, a snap or open hook may be used instead of the cargo hook to secure the suspending strap to the upright structure. The improved means of suspending the hammock makes the installation of the hammock much simpler and faster than the existing method.

Further features of the invention will be described or will become apparent in the course of the following detailed description.

BRIEF DESCRIPTION OF THE DRAWINGS

In order that the disclosed embodiments may be more clearly understood, they are now be described in detail by way of example, with reference to the accompanying drawings, in which identical parts are identified with identical reference numerals and wherein:

FIGS. 2A, 2B and 2C are perspective views of a cam buckle with the bottom portion of the tent attached thereto;

DESCRIPTION OF PREFERRED EMBODIMENTS

Figure 1:
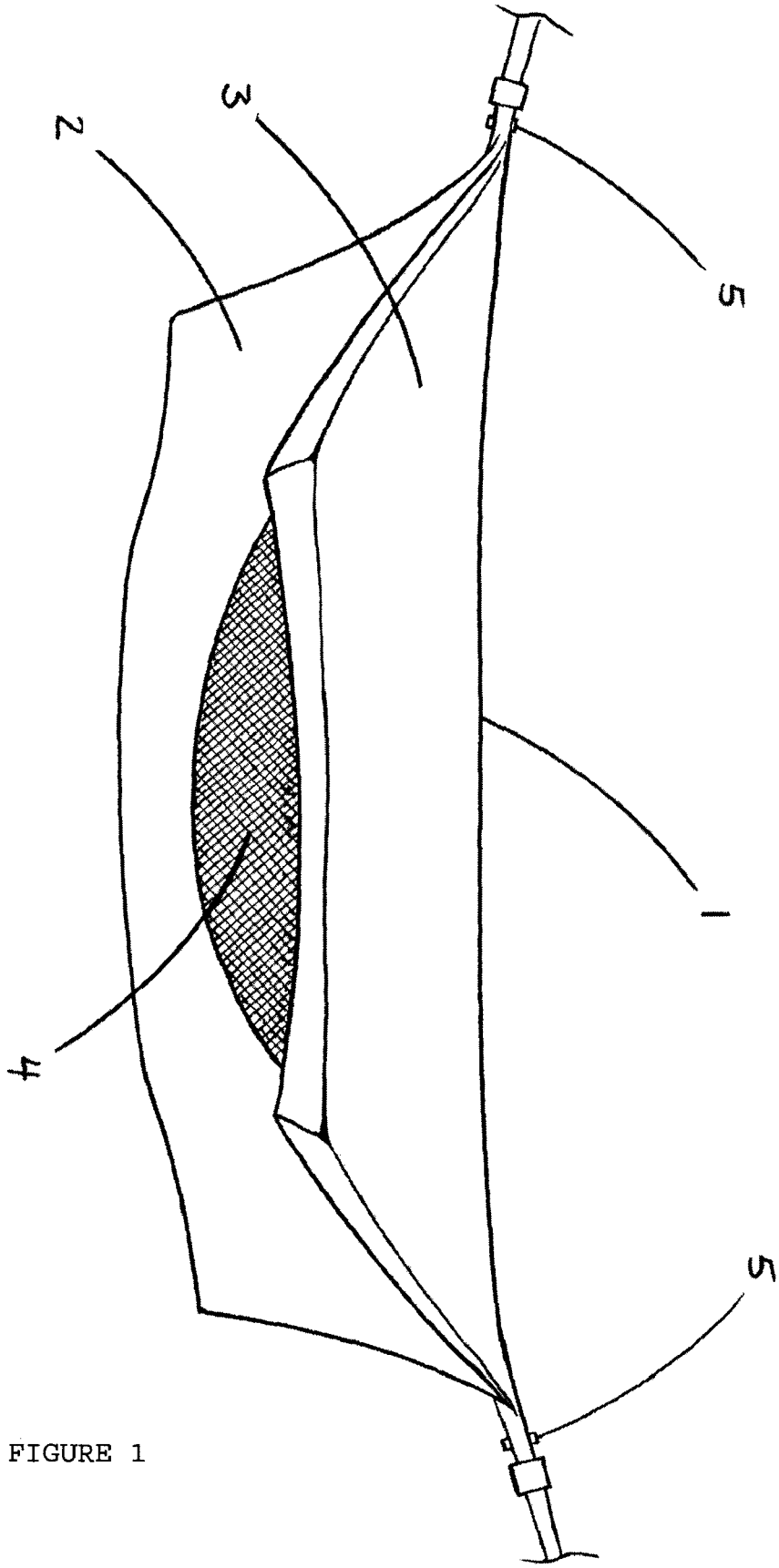
FIG. 1 is a side view of an embodiment of the hammock tent.

Referring to FIG. 1, the tent 1 of the present invention comprises a bottom portion 2 and a top portion 3. An opening 4 is formed when bottom portion 2 and top portion 3 are fully installed. Bottom portion 2 and top portion 3 attach to suspending points 5 of hammock 1 by means of ties and hook and loop fastener, such as that available commercially under the brand VELCRO®, as described in detail in FIGS. 2A, 2B and 2C.

Referring to FIG. 2A, the bottom portion 2 is shown having flat strap 6 and hook and loop fastener pieces 7. As shown in FIG. 2C flat strap 6 is looped through the cam buckle 8 and held in place by hook and loop fastener, as further shown in FIG. 2B. At the same time the hook and loop fastener pieces 7 attach to one another, as shown in FIG. 2B, thus enclosing the hammock completely.

Referring again to FIG. 2A, bottom portion 2 has mesh vent 10 in proximity to suspending point 5. Mesh vent 10 can be closed by way of attaching hook and loop fastener pieces 9 to one another.

Figure 3:
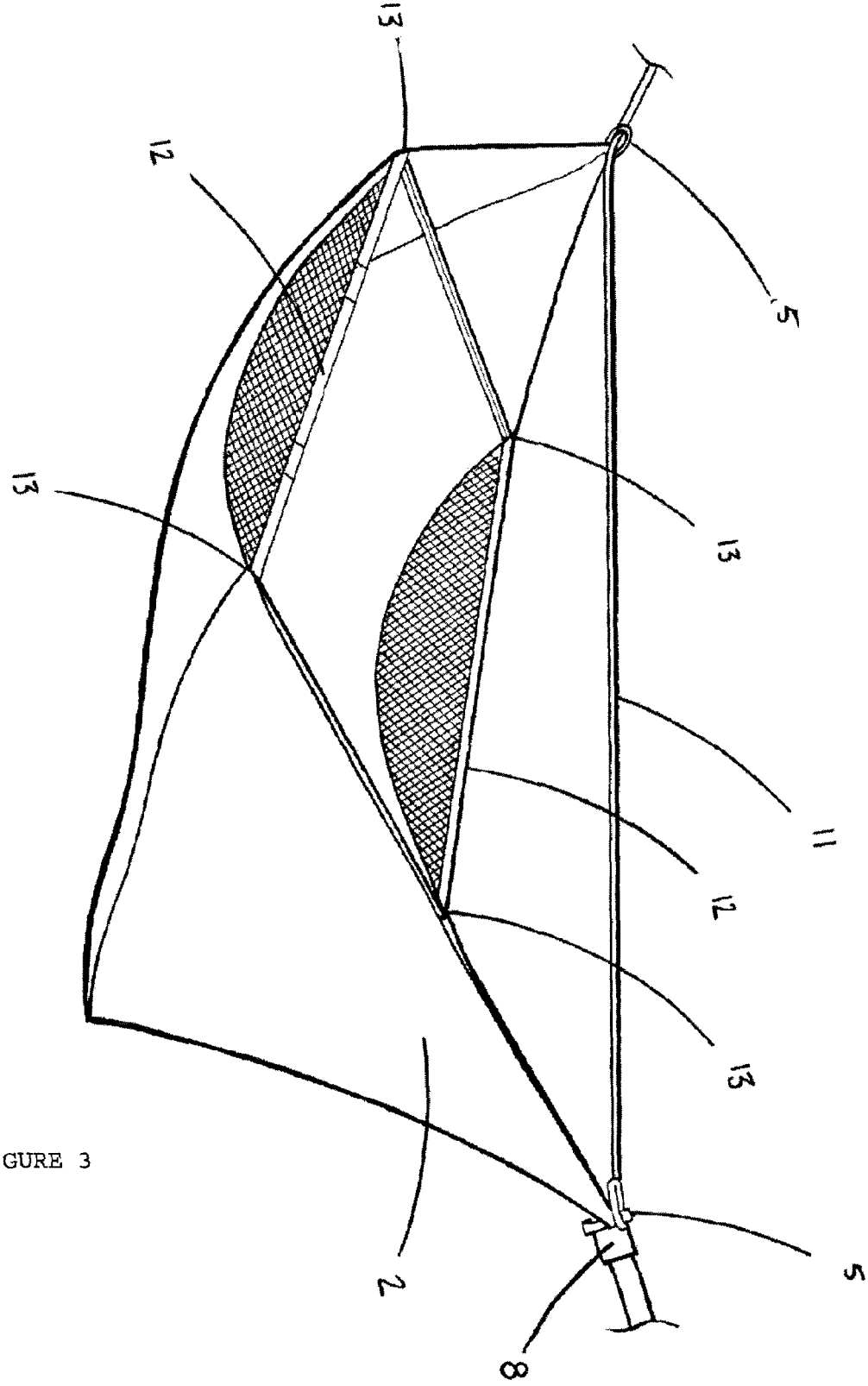
FIG. 3 is a perspective view of the hammock with the bottom portion of the tent attached.

Referring now to FIG. 3, the bottom portion 2 is shown fully installed. FIG. 3 shows ridge support 11 between suspending points 5, as well as side supports 12 on each side of the tent. At each point 13 the bottom portion 2 has hook and loop fastener in order to attach to top portion 3 in the manner shown in FIGS. 5A and 5B.

Figure 4:
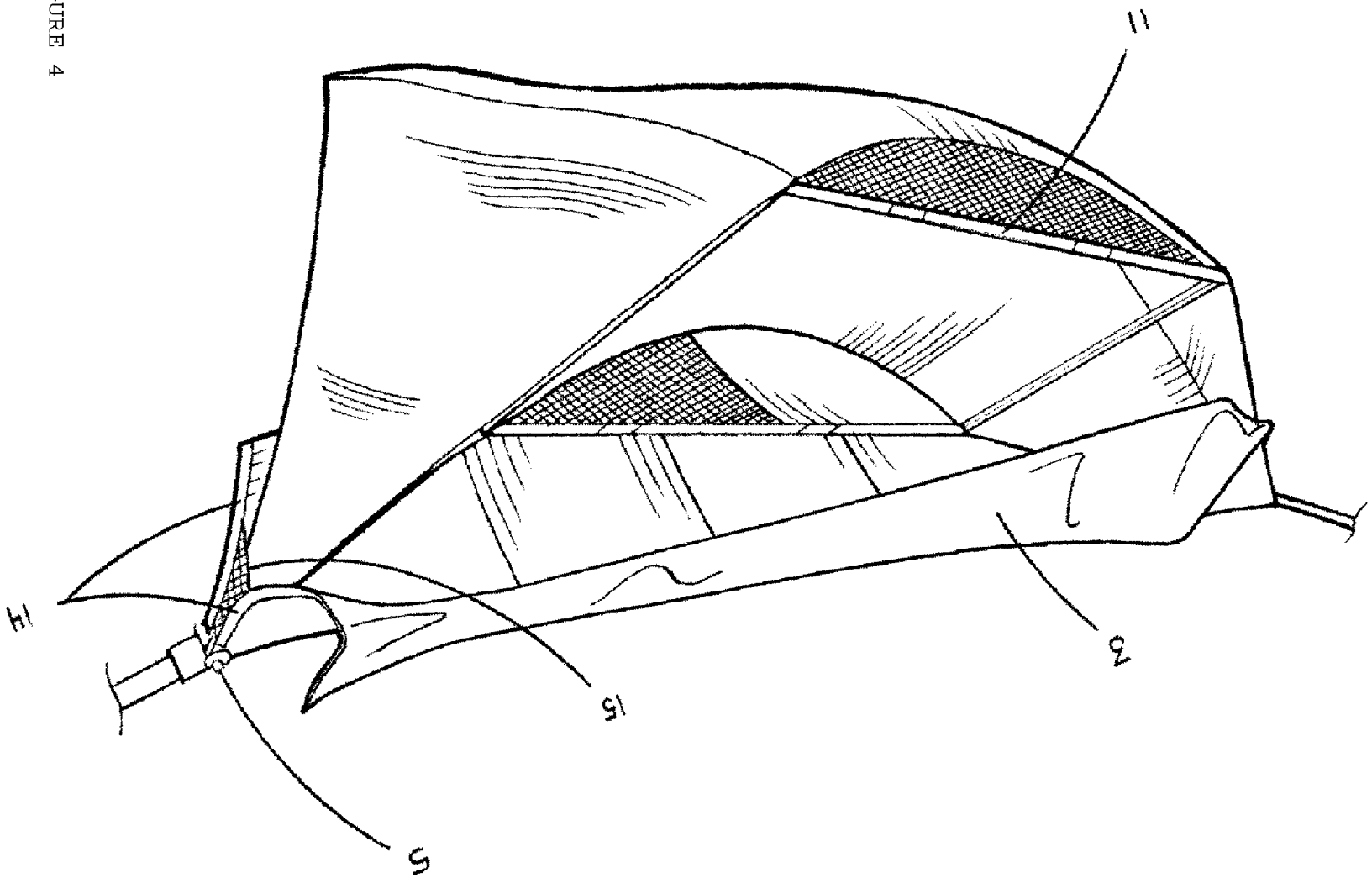
FIG. 4 is a further perspective view of the hammock with the bottom and top portions of the tent attached.
Figure 6:
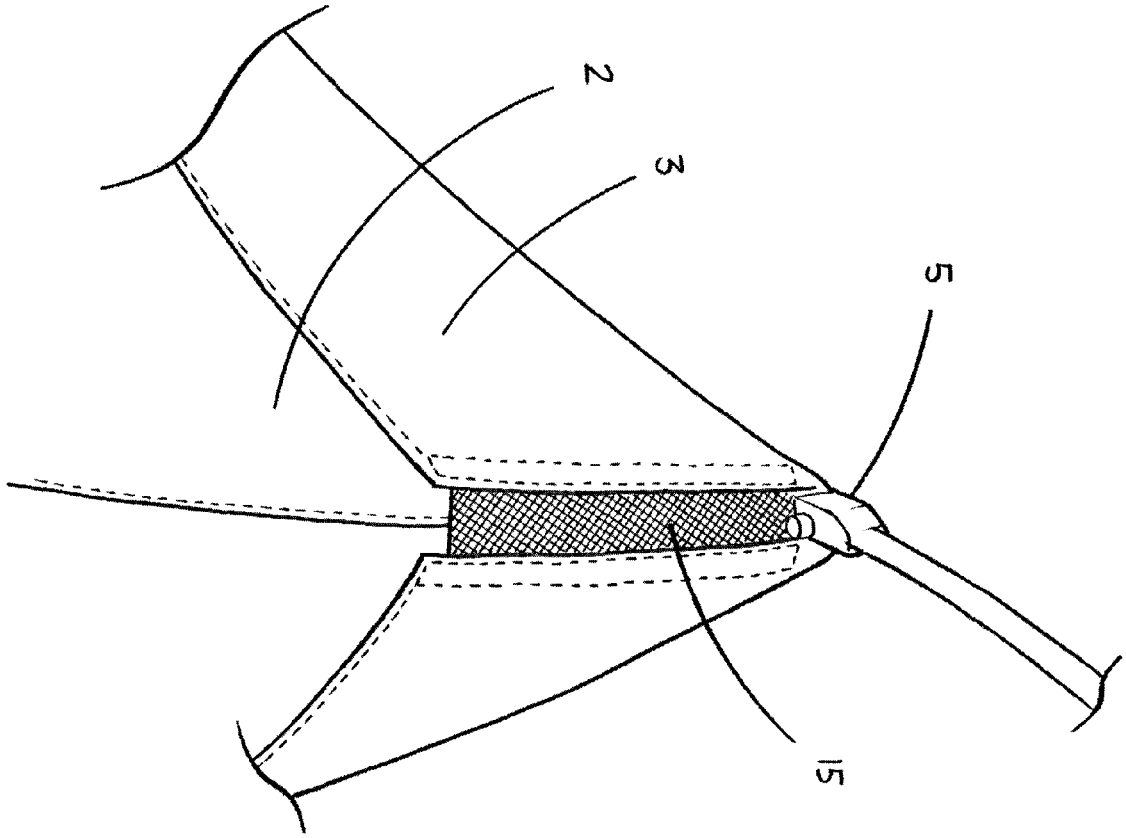
FIG. 6 is a view showing the attachment of the top portion of the tent at a suspending point.

Referring now to FIG. 4, the top portion 3 is shown fitted overtop the ridge support 11 and suspending points 5. At each end, top portion 3 has hook and loop fastener pieces 14, which attach to one another in order to enclose the hammock. Top portion 3 also has mesh vent 15 at each end, in proximity to suspending point 5. As seen in FIG. 6, the mesh vent 15 is shown when top portion 3 is completely closed at suspending point 5.

Figure 5A:
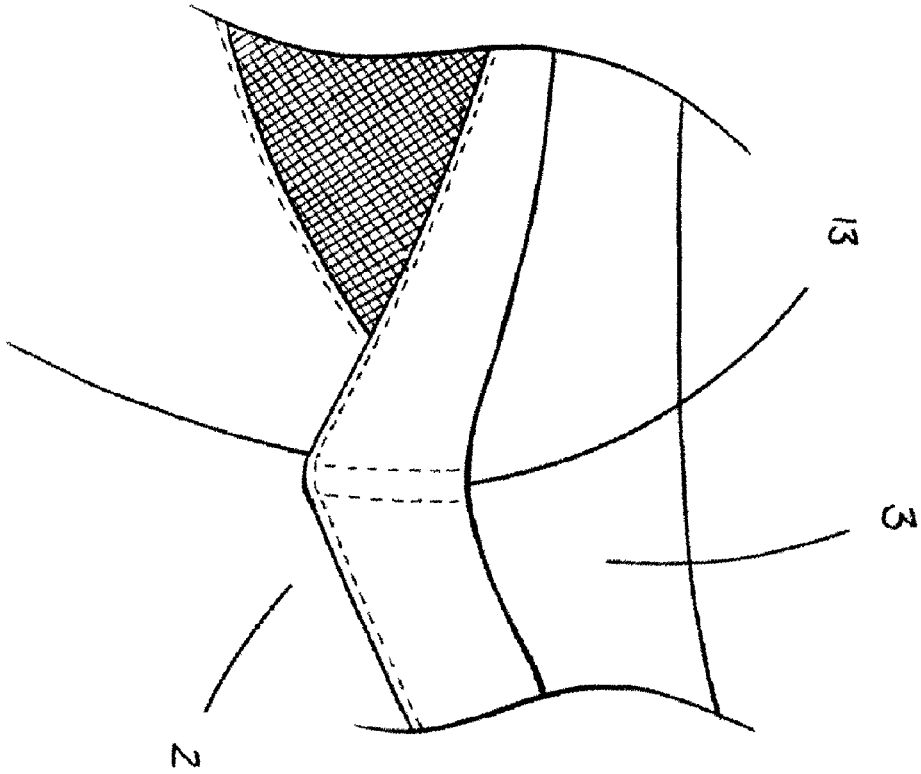
FIGS. 5A and 5B are perspective views of the point of attachment between the bottom and top portions of the tent.
Figure 5B:
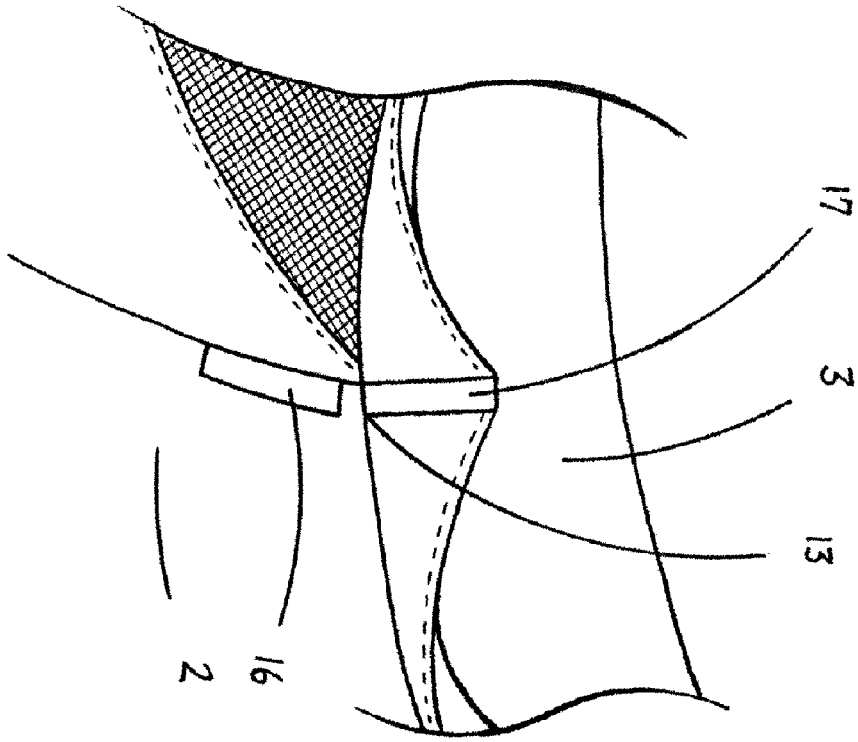

Referring now to FIG. 5A, at each point 13 bottom portion 2 has hook and loop fastener portion 16 and top portion 3 has mating hook and loop fastener portion 17. Hook and loop fastener pieces 16 and 17 attach to one another, as shown in FIG. 5B, such that the tent formed by the bottom portion 2 and top portion 3 completely enclose the hammock.

Figure 7:
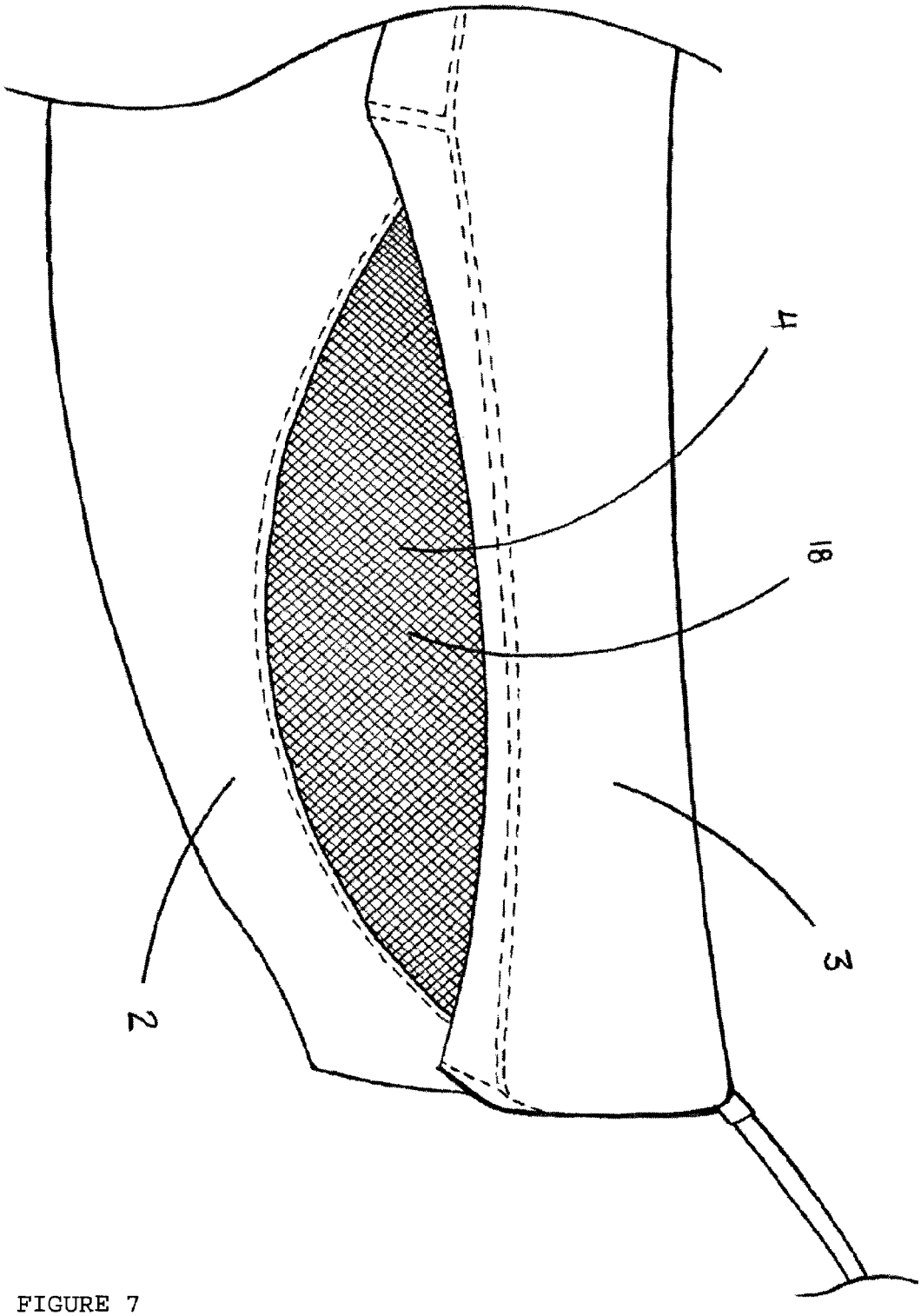
FIG. 7 is a view showing the tent opening being covered with a bug screen.
Figure 8:
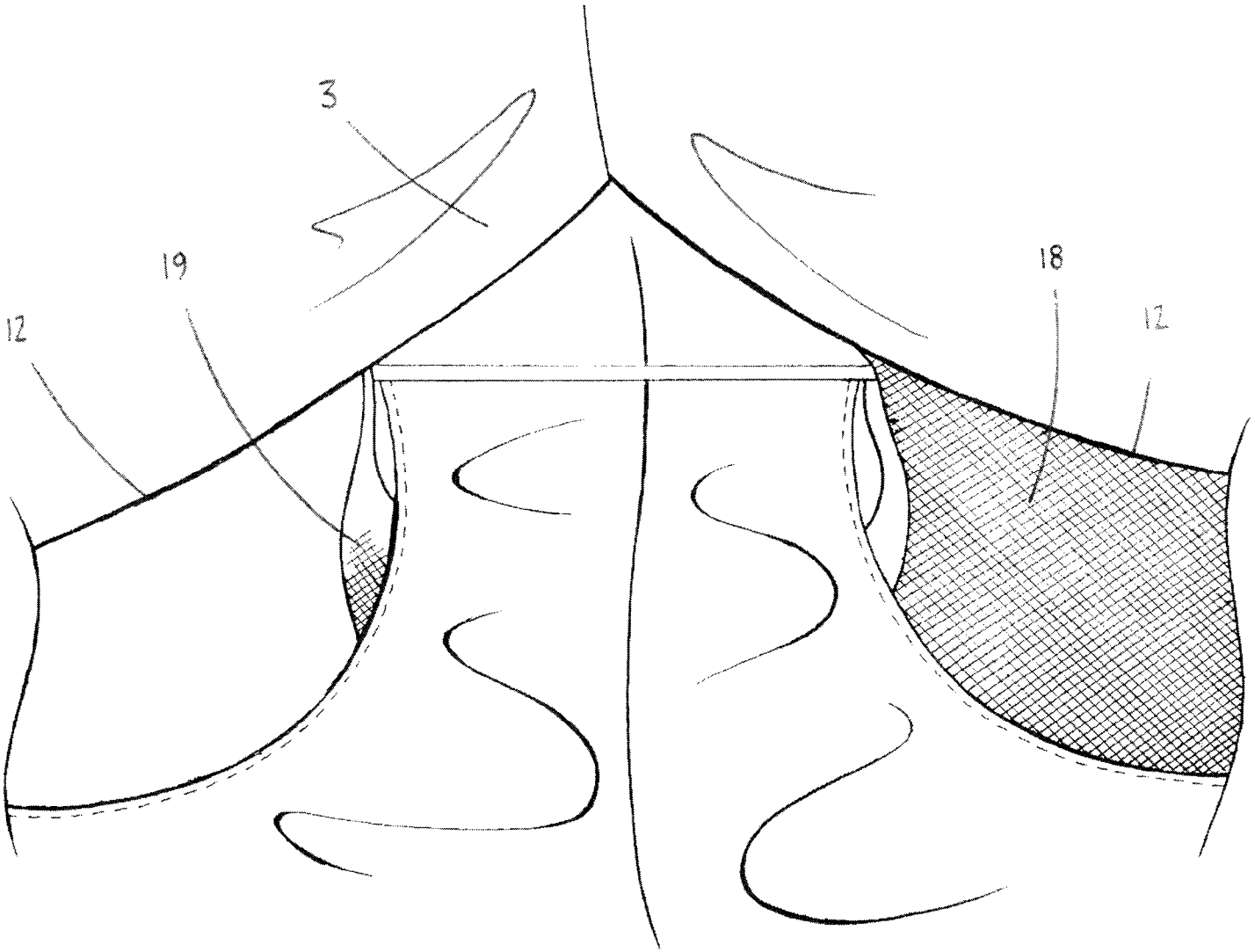
FIG. 8 is a view showing the inside of the tent with the bug screen closed on one side.

FIG. 7 shows the tent opening 4 covered by bug screen 18. In the closed position, the bug screen 18 is secured into place, as shown in FIG. 8. The bug screen 18 is fitted underneath the hammock between the hammock and the bottom cover 2 from one side of the hammock to the other. In the open position, the bug screen is simply dropped and stored in the space between the hammock and the bottom portion 2 as shown at point 19 of FIG. 8. In the closed position, the bug screen is raised and secured to the side supports 12 by means of ties, snaps or hook and loop fastener.

Figure 9:
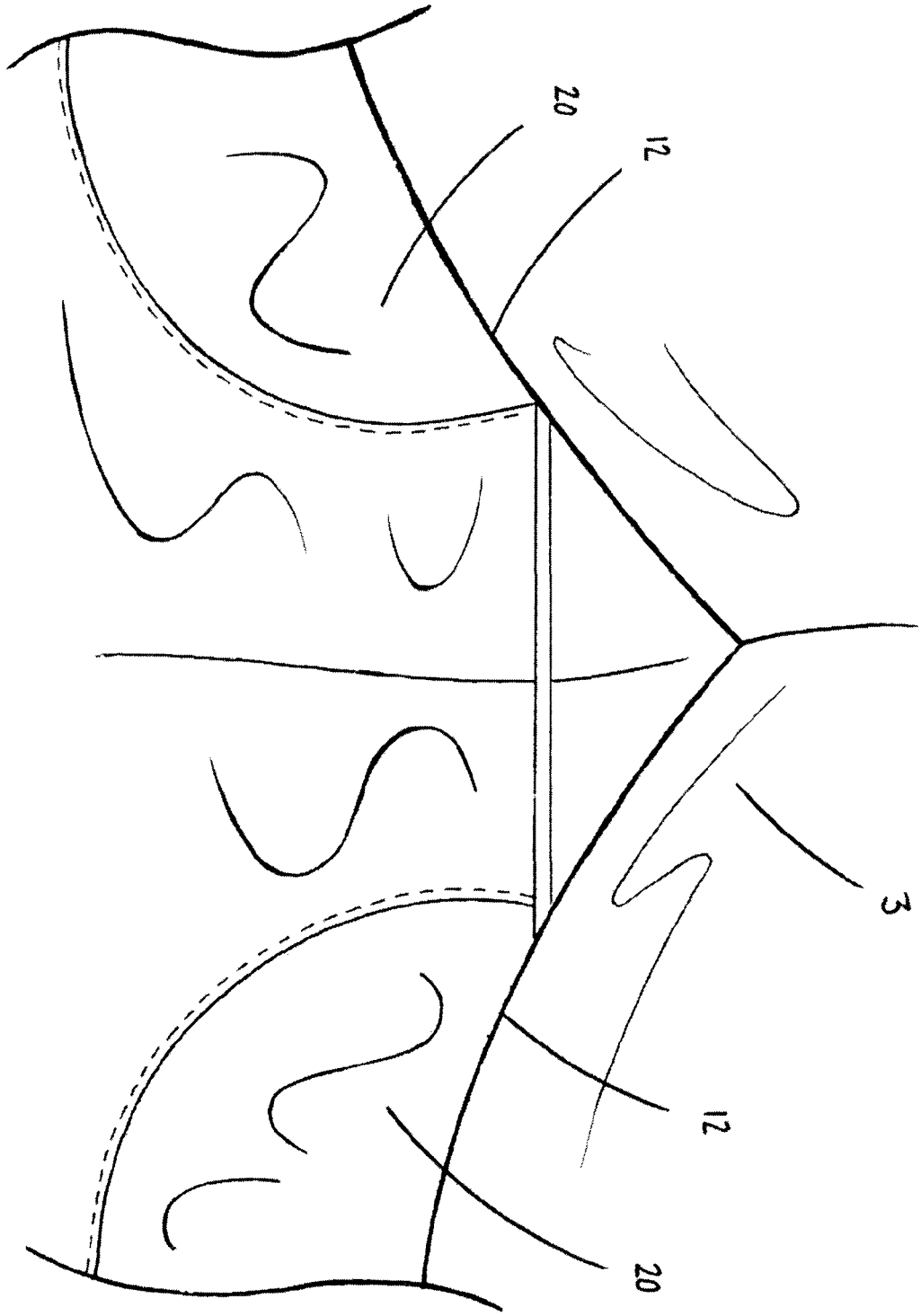
FIG. 9 is a view showing the inside of the tent with the curtain closed on both sides.

Referring now to FIG. 9, the curtain 20 extends similar to the bug screen from one side of the tent to the other, in the space between the hammock and the bottom piece. When the curtain 20 is closed, the curtain can simply be raised and secured to the side supports 12 by means of ties, snaps or hook and loop fastener.

The bug screen 18 and curtain 20 can be opened and closed independent of one another. The edges of the bug screen 18 and curtain 20 can also be attached to one another by means of hook and loop fastener, such that they can be opened and closed as one unit.

Figure 10:
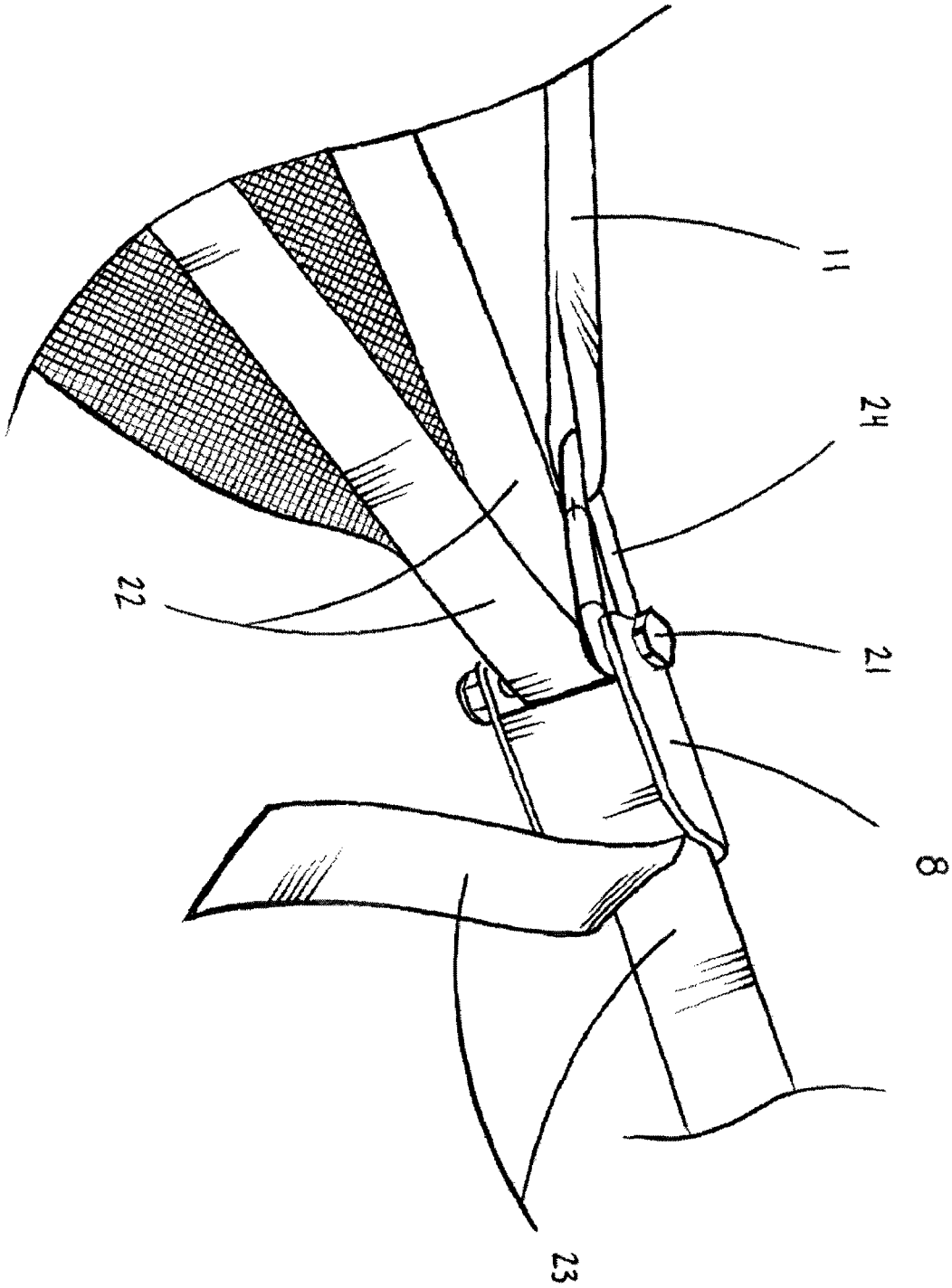
FIG. 10 is a perspective view of a cam buckle attached to the hammock and the suspending strap.

Referring now to FIG. 10, the improved suspending means of the present invention comprises cam buckle 8 and bolt 21. Side straps 22 of the hammock attach to bolt 21 of cam buckle 8. Also attached to cam buckle 8 is suspending strap 23. FIG. 10 also shows the strap comprising ridge support 11 attached to bolt 21 of cam buckle 8 by means of snap hook 24.

Figure 11:
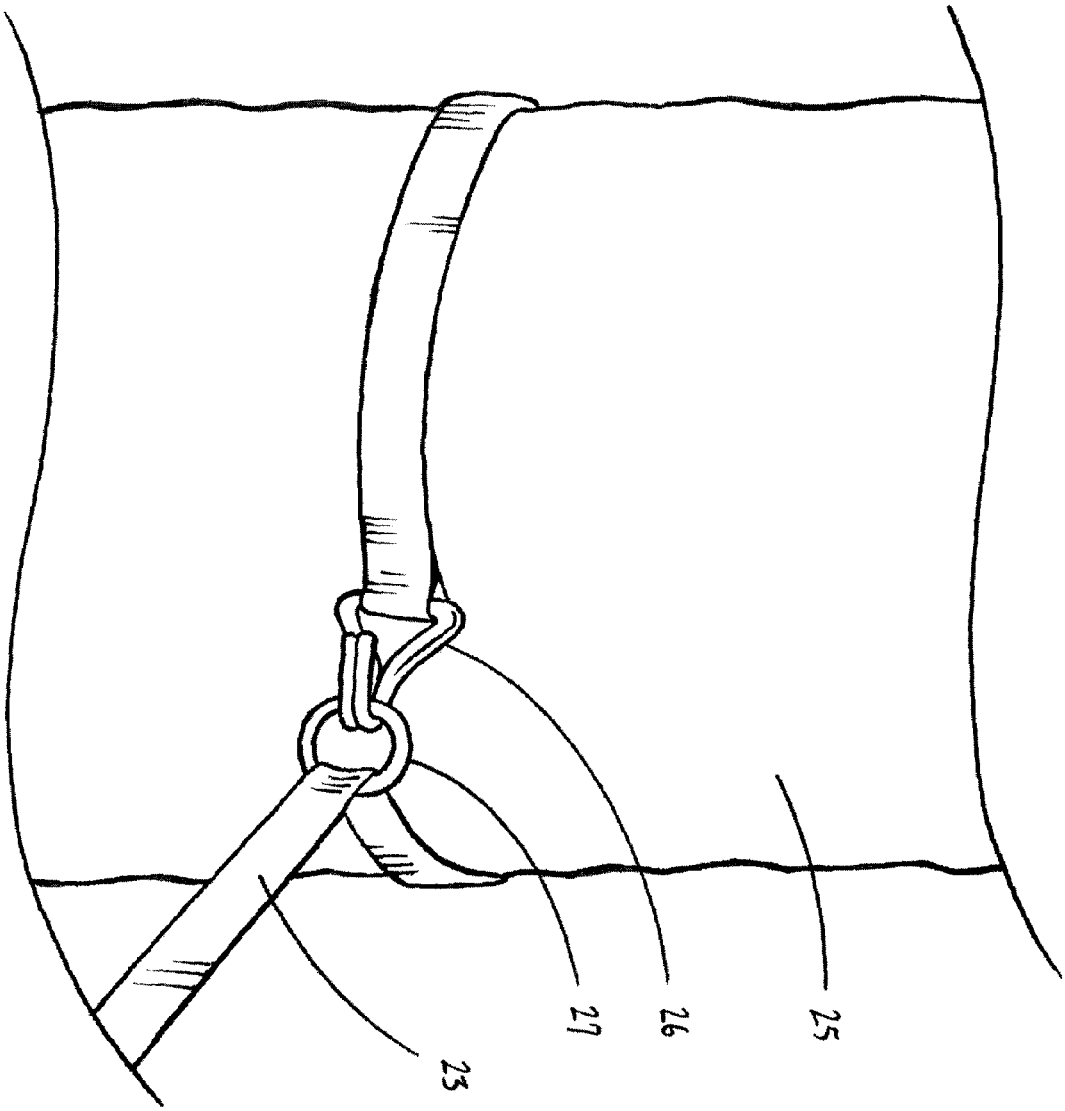
FIG. 11 is a view showing the means of suspending the hammock to an upright structure.

Referring to FIG. 11, suspending strap 23 is shown threaded through D-ring 27. The end of suspending strap 23 is secured to cargo hook 26. After suspending strap 23 is wrapped around upright structure 25, cargo hook 26 is easily attached to D-ring 27. Unwrapping suspending strap 23 from the upright structure 25 can just as easily be accomplished after detaching cargo hook 26 from D-ring 27.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

What is claimed is:

1. A tent for covering a hammock comprising a flexible fabric bed having opposed ends and opposed side edges, cross-braces proximal to the ends, each cross-brace connected to the side edges of the hammock at connection points opposed across the bed from one side edges to the opposite side edge, with the bed pending from the cross-braces so that an occupant may rest level on the bed fully under the cross-braces; connecting means, at each end of the hammock, for connecting to a means for suspending the hammock between a pair of upright structures; and a ridge line connected at each end to the said means for suspending the hammock, the tent comprising:

an almond shaped top cover portion having opposed ends and sides, symmetrically overlying the ridge line along its end-to-end axis, having releasable attachment means at each side proximal to said connecting means and releasably attached at each end to said means for suspending the hammock; and a bottom hull shaped portion having opposed ends and sides underlying the hammock having releasable attachment means at each side proximal to said connecting means and releasably attached at each end to said means for suspending the hammock; wherein said bottom portion including side supports fixedly installed along each side between said releasable attachment means and integral therewith and a door opening beneath said side supports for entry and egress into said hammock wherein the sides of the top portion extend beyond the periphery of the door opening.

2. The tent of claim 1, having at least one mesh vent formed integrally in the top or bottom portion and closure means therefore.

3. The invention of claim 2, wherein said door means may be stowed inside the bottom portion and below the hammock.

4. The tent of claim 1, having a door means for said opening.

5. The tent of claim 4, wherein said door means comprises a foldable bug screen.

6. The tent of claim 4, wherein said door means comprises a foldable curtain.

7. The tent of claim 4, wherein said door means comprises a foldable bug screen and a foldable curtain each operable independent of one another.

* * * * *